US008977144B2

(12) United States Patent
Iwakawa

(10) Patent No.: US 8,977,144 B2
(45) Date of Patent: Mar. 10, 2015

(54) IMAGE FORMING APPARATUS AND SHEET CONVEYING METHOD

(75) Inventor: Tadashi Iwakawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/890,206

(22) Filed: Sep. 24, 2010

(65) Prior Publication Data

US 2011/0076035 A1 Mar. 31, 2011

(30) Foreign Application Priority Data

Sep. 29, 2009 (JP) ..... 2009-224836

(51) Int. Cl.
*G03G 15/00* (2006.01)
*G03G 21/00* (2006.01)

(52) U.S. Cl.
CPC .. *G03G 15/6558* (2013.01); *G03G 2215/00721* (2013.01); *G03G 2215/00945* (2013.01); *G03G 2215/1666* (2013.01)
USPC ..... 399/16; 399/388; 399/394; 399/312; 399/396; 399/303

(58) Field of Classification Search
USPC ..... 399/16, 388, 394, 312, 396, 162, 303, 399/66
See application file for complete search history.

(56) References Cited

U.S. PATENT DOCUMENTS 5,276,491 A * 1/1994 Fuma et al. ..... 399/315
7,006,785 B2 * 2/2006 Embry ..... 399/388
2004/0258442 A1 * 12/2004 Uchida et al. ..... 399/396

FOREIGN PATENT DOCUMENTS

JP 10-247022 A 9/1998
JP 11-143297 A 5/1999
JP 2000-185839 7/2000
JP 2007-320760 A 12/2007

* cited by examiner

*Primary Examiner* — Matthew G Marini
(74) *Attorney, Agent, or Firm* — Canon U.S.A., Inc. IP Division

(57) ABSTRACT

An image forming apparatus includes a pre-transfer conveying portion that conveys a recording medium, an image bearing member that moves while bearing a toner image, a conveying belt that attracts the recording medium conveyed from the pre-transfer conveying portion and conveys the recording medium at the same speed as the image bearing member, a detecting portion that detects the recording medium attracted to the conveying belt, and a control unit that controls the speed at which the pre-transfer conveying portion conveys the recording medium. On the basis of the detection of the recording medium, the control unit changes the speed of the pre-transfer conveying portion from a speed slower than the speed of the conveying belt to a speed equal to or faster than the speed of the conveying belt, and thereby causes the leading edges of the toner image and the recording medium to coincide.

7 Claims, 4 Drawing Sheets

IMAGE FORMING APPARATUS AND SHEET CONVEYING METHOD

BACKGROUND OF THE INVENTION

1. Field of the Invention

The present invention relates to an image forming apparatus that forms an image on a recording medium using electrophotographic technology, such as a copying machine, a printer, or a facsimile machine, and more specifically, it relates to a type of image forming apparatus that transfers an image to a recording medium in a nip between an image bearing member and a conveying belt, and a sheet conveying method.

2. Description of the Related Art

An electrophotographic image forming apparatus is configured to transfer an image formed on an image bearing member to a recording medium in a transfer portion, to convey the recording medium to a fixing device, where the image is fixed, and then to output the recording medium. In such an image forming apparatus, in order to transfer the image to the recording medium without causing defective transfer, it is necessary to stably convey the leading edge of the recording medium when conveying the recording medium to the transfer portion.

For example, if there is an upward curl (a curl that is convex downward) at the leading edge of the recording medium, the upward curl is flattened when the leading edge of the recording medium enters the transfer portion, and the leading edge of the recording medium is thereby slightly displaced in the conveying direction. As a result, the leading edge of the recording medium rubs against the image formed on the image bearing member, and therefore the image may be disrupted.

So, in order to stably convey the leading edge of the recording medium to the transfer portion, a technique is proposed in which a conveying belt that attracts and conveys a recording medium is disposed opposite to an image bearing member, and a transfer nip where an image is transferred to the recording medium is formed between the conveying belt and the image bearing member. This technique is described in Japanese Patent Laid-Open No. 2000-185839. In this configuration, the recording medium is conveyed to the transfer nip while being attracted to the conveying belt, and an image formed on the image bearing member is transferred to the recording medium in the transfer nip. As described above, by attracting the recording medium to the conveying belt, the curled leading edge of the recording medium can be flattened along the conveying belt, and the leading edge can be stably conveyed to the transfer nip.

However, the conventional image forming apparatus in which the conveying belt is used in the transfer portion has the following problems. This image forming apparatus can stably convey the recording medium to the transfer nip by attracting the curled leading edge of the recording medium to the conveying belt. However, when a curl is formed at the leading edge of the recording medium, the position of the leading edge of the recording medium at the time when the leading edge of the recording medium is attracted into contact with the conveying belt may vary.

For example, if there is a downward curl (a curl that is convex upward) at the leading edge of the recording medium to be conveyed to the conveying belt, the site where the leading edge of the recording medium lands on the conveying belt is slightly displaced upstream in the conveying direction compared to the case where there is no curl. The recording medium is conveyed to the transfer nip with the displacement uncorrected. The larger the size of curl, the larger the displacement.

The conveying belt 45 rotates at the same speed as the image bearing member rotating at a constant speed (process speed). Therefore, once the position of the leading edge of the recording medium is displaced, the displacement cannot be corrected.

If the position of the leading edge of the recording medium relative to the conveying belt varies depending on the size of curl as described above, the position of the image relative to the recording medium varies when the image is transferred to the recording medium in the transfer nip, and image displacement occurs.

SUMMARY OF THE INVENTION

In a type of image forming apparatus in which a recording medium is attracted and conveyed by a conveying belt and an image is transferred to the recording medium, the present invention reduces displacement of the image on the recording medium.

In an aspect of the present invention, an image forming apparatus includes a pre-transfer conveying portion, an image bearing member, a conveying belt, a transfer nip, a recording medium detecting portion, and a control unit. The pre-transfer conveying portion conveys a recording medium. The image bearing member moves while bearing a toner image. The conveying belt is pressed against the image bearing member. The conveying belt has a conveying force smaller than the conveying force of the pre-transfer conveying portion. The conveying belt attracts the recording medium conveyed from the pre-transfer conveying portion to the outer surface and conveys the recording medium at the same speed as the image bearing member. The transfer nip conveys the recording medium while nipping the recording medium between the conveying belt and the image bearing member and thereby transfers the toner image borne by the image bearing member to the recording medium. The recording medium detecting portion is located on the upstream side of the transfer nip in the recording medium conveying direction and detects the recording medium attracted to the conveying belt. The control unit controls the conveying speed at which the pre-transfer conveying portion conveys the recording medium. On the basis of the detection of the recording medium attracted to the conveying belt by the recording medium detecting portion, the control unit changes the conveying speed of the pre-transfer conveying portion from a conveying speed slower than the conveying speed of the conveying belt to a conveying speed equal to or faster than the conveying speed of the conveying belt so that the conveying belt conveys the recording medium while attracting the recording medium, and thereby causes the leading edge of the toner image and the leading edge of the recording medium to coincide.

Further features of the present invention will become apparent from the following description of exemplary embodiments with reference to the attached drawings.

DESCRIPTION OF THE EMBODIMENTS

Figure 1:
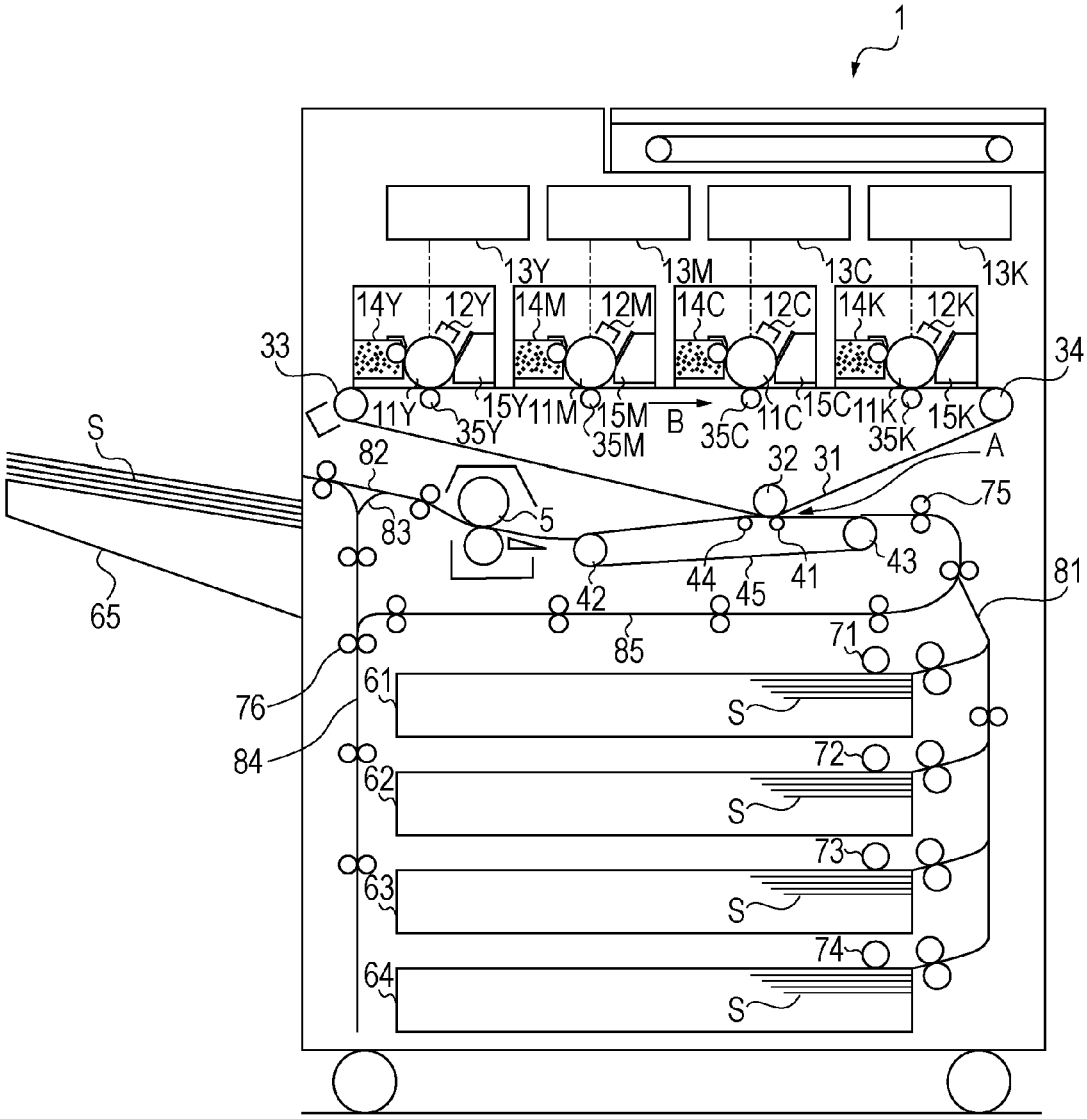
FIG. 1 is a schematic sectional view of an image forming apparatus having a conveying belt that is an example of an embodiment of the present invention.

The embodiments of the present invention will now be described with reference to the drawings. FIG. 1 shows a schematic sectional view of an image forming apparatus 1 that is an example of an embodiment of the present invention.

Process of Conveying Recording Medium

Recording media S are stored in paper cassettes 61 to 64 disposed in the lower part of the image forming apparatus 1. Recording media S are fed by paper feeders 71 to 74 in timed relationship with the image formation. A recording medium S sent out by one of the paper feeders 71 to 74 passes through a conveying path 81 and is conveyed to a registration roller pair 75 serving as a pre-transfer conveying portion. In the registration roller pair 75, the recording medium S being conveyed from one of the paper cassettes 61 to 64 hits against the nip of the roller pair, and a loop is formed. Thus, the skew of the recording medium S is corrected. After the skew of the recording medium S is corrected in the registration roller pair 75, the registration roller pair 75 conveys the recording medium S to a transfer nip A serving as a secondary transfer portion. In this embodiment, the transfer nip A is formed by pressing a secondary transfer inner roller 32 and a secondary transfer pressure roller 41 against each other. By applying an electrostatic load bias while nipping and conveying the recording medium S, an image is transferred from an intermediate transfer belt 31 to be described below.

Process of Forming Image

A description will be given of the process of forming the image sent to the transfer nip A in timed relationship with the above-described process of conveying the recording medium S.

Each image forming portion mainly includes a photosensitive member 11 (11Y, 11M, 11C, 11K), a charging device 12 (12Y, 12M, 12C, 12K), and an exposure device 13 (13Y, 13M, 13C, 13K). In addition, each image forming portion includes a developing device 14 (14Y, 14M, 14C, 14K), a primary transfer device 35 (35Y, 35M, 35C, 35K), and a photosensitive member cleaner 15 (15Y, 15M, 15C, 15K).

On the photosensitive member 11 the surface of which is uniformly charged by the charging device 12 and that is rotating, a latent image is formed by the exposure device 13 on the basis of a received signal of image information. The developing device 14 develops the electrostatic latent image formed on the photosensitive member 11 and forms an image of toner (toner image). After that, the intermediate transfer belt 31 is pressed and electrostatically biased by the primary transfer device 35, and the toner image formed on the photosensitive member 11 is transferred to the intermediate transfer belt 31. A little toner remaining on the photosensitive member 11 is recovered by the photosensitive member cleaner 15 to prepare for the next image formation. The image forming apparatus 1 of FIG. 1 has four such image forming portions of yellow (Y), magenta (M), cyan (C), and black (Bk). Of course, the number of colors is not limited to four, and the order in which the colors are arranged is not limited to the order of FIG. 1.

Next, the structure and operation of the intermediate transfer belt 31 serving as an image bearing member will be described. The intermediate transfer belt 31 is stretched by rollers such as a driving roller 33, a tension roller 34, and a secondary transfer inner roller 32 and rotates in the direction of arrow B in the figure at a constant speed. The above-described processes of forming images of Y, M, C, and Bk are performed in such a manner that a toner image is primary-transferred from the upstream side onto the intermediate transfer belt 31 rotating at a constant speed, and then another image is superposed thereon on the downstream side. As a result, finally, a full-color toner image is formed on the intermediate transfer belt 31 and is conveyed to the secondary transfer portion.

Process of Secondary Transfer and Subsequent Processes

The toner image formed on the intermediate transfer belt 31 is secondary-transferred onto the recording medium S in the transfer nip A serving as a secondary transfer portion. After that, the recording medium S is conveyed to a fixing device 5, where pressure and heat are applied to the recording medium S by a roller pair of the fixing device 5, and the toner image is thereby fused to the recording medium S.

When duplex image formation is not performed (in the case of one-side image formation), the recording medium S to which the image is fixed is output onto a paper output tray 65 through a paper output conveying path 82. When duplex image formation is performed (in the case of image formation on the other side of the recording medium S), the recording medium S to which the image is fixed is conveyed to a reversal guide path 83 and is then conveyed to a switchback path 84. A reversal roller 76 provided in the switchback path 84 conveys the recording medium S over a predetermined distance and then counter-rotates to convey the recording medium S to a duplex conveying path 85. After that, the recording medium S is again sent through the registration roller pair 75 to the transfer nip A, where an image formed on the intermediate transfer belt 31 is transferred to the reverse side of the recording medium S. The recording medium S is then sent to the fixing device 5, where the transferred toner image is fixed to the recording medium S. The process of image formation on the second side is the same as the process of image formation on the first side described above. So, the description thereof will be omitted.

In the case where the recording medium S is reversed before being output, after the recording medium S passes through the fixing device 5, the recording medium S is conveyed from the reversal guide path 83 to the switchback path 84 and is then output onto the paper output tray 65 through the paper output conveying path 82.

Conveying Belt and Registration Control of the Present Invention

Figure 2:
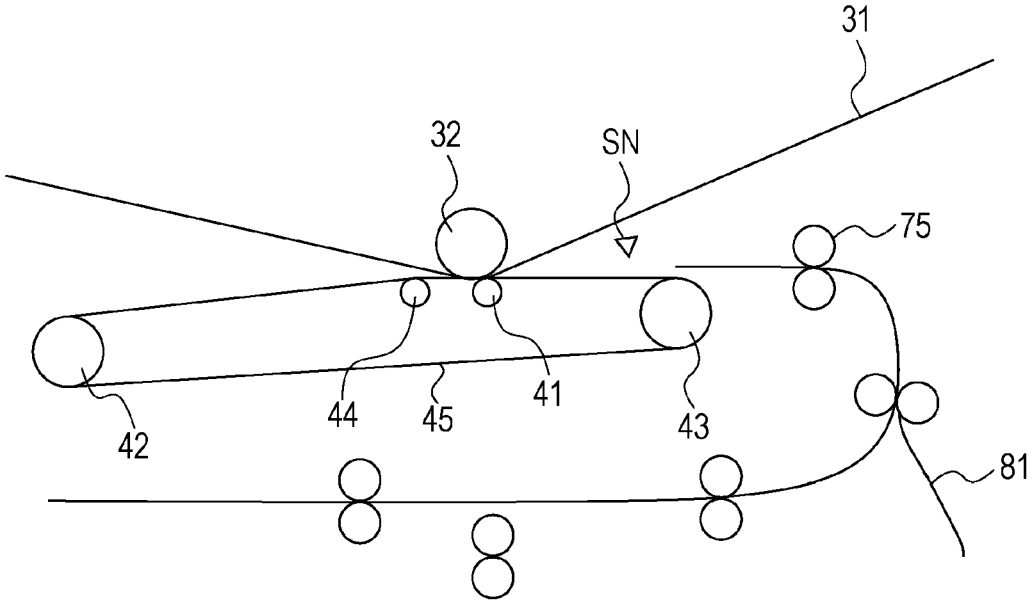
FIG. 2 is a partial sectional view of the vicinity of a conveying belt that is an example of an embodiment of the present invention.
Figure 3:
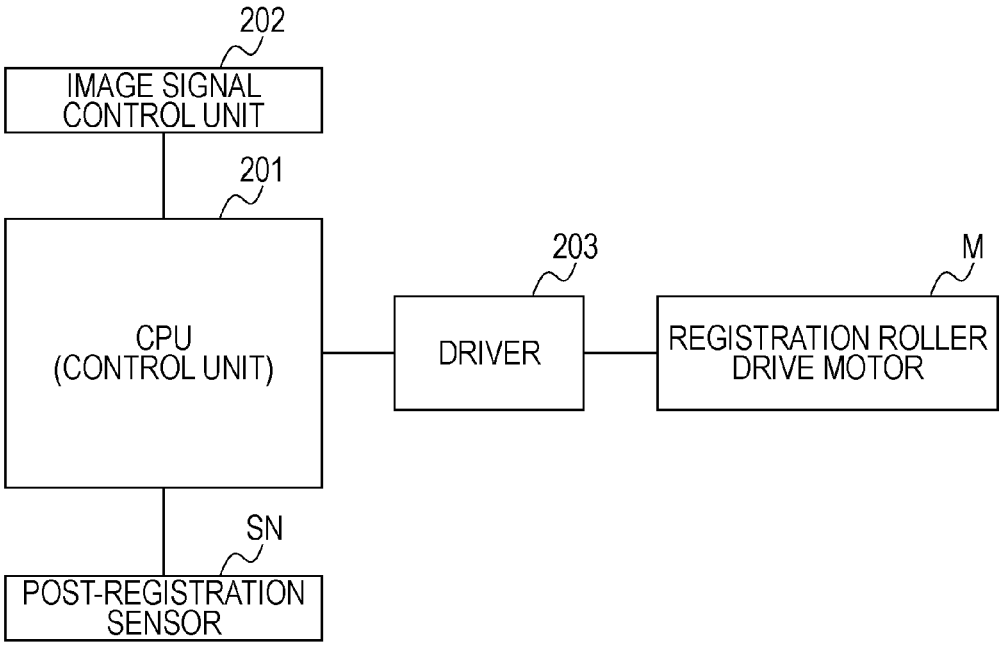
FIG. 3 is a block diagram on an embodiment of the present invention.
Figure 4:
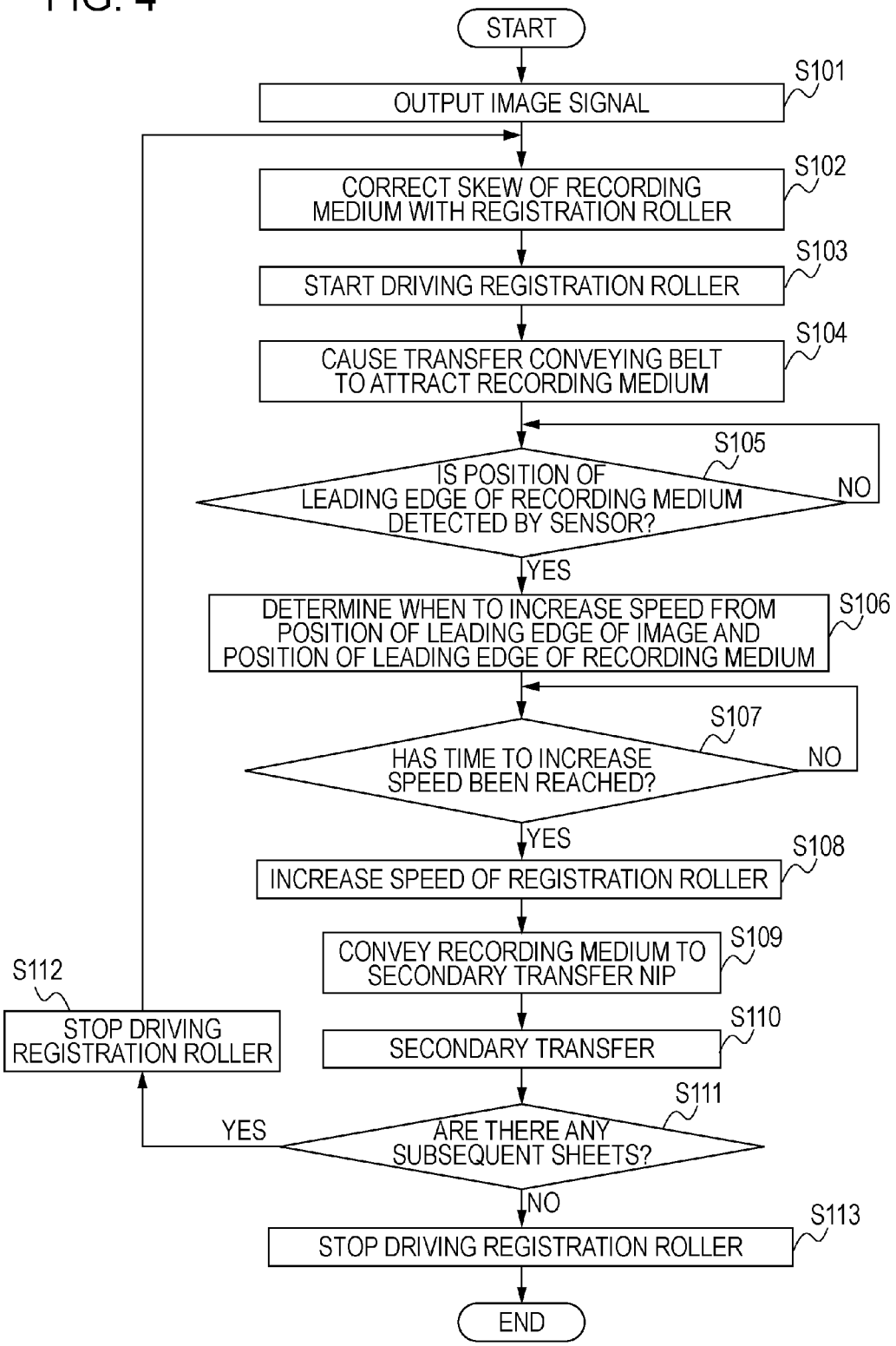
FIG. 4 is a flowchart on an embodiment of the present invention.

The conveying control of the recording medium S by the conveying belt 45 and the registration roller pair 75, which is a feature of the present invention, will be described in detail. FIG. 2 shows a partial sectional view of the vicinity of a conveying belt that is an example of an embodiment of the present invention. FIG. 3 shows a block diagram on an embodiment of the present invention. FIG. 4 shows a flowchart on an embodiment of the present invention.

As shown in FIG. 2, the conveying belt 45 is stretched by a transfer driving roller 42 and a transfer conveying belt tension rollers 43 and 44 and rotates in a direction in which a recording medium is conveyed (the counterclockwise direction in the figure). The conveying belt 45 is electrostatically charged by an electrostatic device (not shown) and can convey the recording medium S while attracting the recording medium S to the outer surface of the belt. The secondary transfer pressure roller 41 placed inside the conveying belt 45 is pressed against the secondary transfer inner roller 32 with the conveying belt 45 and the intermediate transfer belt 31 therebetween. The recording medium S is conveyed by the conveying belt 45. In the transfer nip A, a pressure and an electrostatic load bias are applied to the recording medium S by the secondary transfer pressure roller 41, and a toner image is thereby transferred from the intermediate transfer belt 31 to the recording medium S.

In this embodiment, as shown in FIG. 2, a post-registration sensor SN is disposed upstream of the transfer nip A so as to face the conveying belt 45. The post-registration sensor SN serves as a recording medium detecting portion. The post-registration sensor SN is a sensor for detecting the leading edge of the recording medium S being attracted and conveyed by the conveying belt 45. The leading edge of the recording medium S means the edge of the recording medium S on the downstream side in the recording medium conveying direction.

FIG. 3 is a block diagram showing the configuration of a controller that controls the image forming apparatus 1 of this embodiment. As shown in FIG. 3, the controller includes a CPU 201 serving as a control unit. An image signal control unit 202 converts an analog image signal from an image sensor (not shown) into a digital signal and then performs various image processing operations, or performs various image processing operations on a digital image signal input from an external computer or the like through an external interface (not shown). The processing operations of the image signal control unit 202 are controlled by the CPU 201.

A driver 203 is connected to the CPU 201. The driver 203 drives a registration roller drive motor M. The post-registration sensor SN is connected to the CPU 201 so that the detection signal of the post-registration sensor SN is input into the CPU 201.

With reference to the flowchart of FIG. 4, the control of the registration roller pair 75 in the secondary transfer portion will be described.

A print job starts in the image forming apparatus 1 (S101). In response to the image signal obtained from the image signal control unit 202, a paper feed operation is performed at a predetermined timing. A recording medium S is conveyed from the paper cassette to the registration roller pair 75. The image signal control unit 202 starts rotation of the intermediate transfer belt 31 at a predetermined timing and starts primary transfer of respective colors of toner images from the photosensitive members 11.

After that, the recording medium S being conveyed hits against the nip of the registration roller pair 75 at rest, and a loop is formed. Thus, the skew is corrected (S102). The driving of the registration roller pair 75 is started (S103), and the recording medium S is sent out. The driving is started in a state where the distance that the leading edge of the recording medium S travels before reaching the transfer nip A is shorter than the distance that the leading edge of the toner image primary-transferred to the intermediate transfer belt 31 rotating at a constant speed travels before reaching the transfer nip A. The leading edge of the toner image means the edge of the toner image on the downstream side in the rotating direction of the intermediate transfer belt 31.

The toner image formed on the intermediate transfer belt 31 includes the margin on the side of the leading edge of the recording medium S to which the toner image is transferred. Therefore, by performing transfer with the leading edge of the toner image formed on the intermediate transfer belt 31 coincident with the leading edge of the recording medium S, an image is formed at the proper position on the recording medium S.

The registration roller pair 75 is driven by the registration roller drive motor M. At the start of driving, the conveying speed of the registration roller pair 75 is set slower than the conveying speed of the conveying belt 45. After that, the recording medium S being conveyed by the registration roller pair 75 is electrostatically attracted to the conveying belt 45 (S104). The conveying speed of the registration roller pair 75 means the speed that the registration roller pair 75 gives to the recording medium S in a state where the recording medium S does not slip on the registration roller pair 75. The conveying speed of the registration roller pair 75 is equal to the peripheral speed of the registration roller pair 75.

In this case, if the recording medium S is conveyed from the registration roller pair 75 with the leading edge of the recording medium S curled, the recording medium S is attracted by the conveying belt 45, and the curl is flattened.

Parameters are set such that the following relationship holds:

$$\mu bp \cdot F < \mu rp \cdot N,$$

where μbp is the coefficient of friction between the conveying belt and the recording medium, μrp is the coefficient of friction between the registration roller and the recording medium, F is the attraction force with which the conveying belt 45 attracts the recording medium S, and N is the load applied to the recording medium S from the registration roller pair 75. Thus, after the leading edge of the recording medium S is passed to the conveying belt 45, the recording medium S is conveyed at a conveying speed of the registration roller pair 75 slower than the conveying speed of the conveying belt 45. That is to say, the conveying force of the registration roller pair 75 is set larger than the conveying force of the conveying belt 45, and therefore the recording medium S is conveyed at the conveying speed of the registration roller pair 75 slower than the conveying speed of the conveying belt 45 while slipping on the conveying belt 45. The conveying speed of the conveying belt 45 means the speed that the conveying belt 45 gives to the recording medium S in a state where the recording medium S does not slip on the conveying belt 45. The conveying speed of the conveying belt 45 is equal to the peripheral speed of the conveying belt 45.

The conveying belt 45 rotates at the same speed as the speed of the intermediate transfer belt 31 rotating at a constant speed (process speed). For this reason, if the conveying force of the registration roller pair 75 is smaller than the conveying force of the conveying belt 45, the recording medium S is attracted to the conveying belt 45 and moves at the same speed as the conveying belt 45. In this state, because the conveying belt 45 rotates at the same constant speed as the speed of the intermediate transfer belt 31, the timing to convey the recording medium S to the transfer nip A cannot be adjusted when transferring the toner image to the recording medium S.

So, in this embodiment, for timing adjustment for causing the leading edge of the toner image on the intermediate transfer belt 31 and the leading edge of the recording medium S to coincide in the transfer nip A, the conveying force of the registration roller pair 75 is set larger than the conveying force of the conveying belt 45 as described above. In addition, the conveying speed of the registration roller pair 75 is set slower than the conveying speed of the conveying belt 45. Consequently, the recording medium S can be caused to slip on the conveying belt 45, and the recording medium S is conveyed at the conveying speed of the registration roller pair 75 slower than the conveying speed of the conveying belt 45.

Thus, the timing to convey the recording medium S to the transfer nip A can be adjusted by changing the conveying speed of the registration roller pair 75. The details will be described below.

The leading edge of the recording medium S being electrostatically attracted and conveyed by the conveying belt 45 is detected by the post-registration sensor SN (S105, the first step).

A distance L1 is the travel distance that the leading edge of the recording medium S travels after being detected by the post-registration sensor SN but before reaching the transfer nip A. When the post-registration sensor SN detects the leading edge of the recording medium S, the CPU 201 calculates the distance L2 along the outer surface of the intermediate transfer belt 31 from the leading edge of the toner image to the transfer nip A. The distance L2 is the travel distance that the leading edge of the toner image on the intermediate transfer belt 31 travels with the rotation of the intermediate transfer belt 31 after the detection of the leading edge by the post-registration sensor SN but before reaching the transfer nip A.

On the basis of the difference between L2 and L1, the CPU 201 calculates the timing to increase the speed of the registration roller pair 75 such that the leading edge of the toner image coincides with the leading edge of the recording medium S in the transfer nip A (S106, the second step). The relationship between the distances L1 and L2 is controlled such that L2>L1 when the leading edge is detected by the post-registration sensor SN. Thus, by increasing the conveying speed of the registration roller pair 75 at the appropriate timing on the basis of the detection of the leading edge of the recording medium S by the post-registration sensor SN, the relationship between the distances L1 and L2 can be adjusted such that L2=L1. By adjusting such that L2=L1, the toner image can be transferred to the proper position on the recording medium S.

When the time to increase the speed has been reached (S107), the speed of the registration roller pair 75, which is set to a speed slower than that of the conveying belt 45, is increased (S108, the third step).

The conveying speed of the registration roller pair 75 at this time is set to a speed equal to or slightly faster than the conveying speed of the conveying belt 45. Thus, while the leading edge of the recording medium S is attracted by the conveying belt 45 and moves at the process speed, a loop is formed in the recording medium S between the conveying belt 45 and the registration roller pair 75. Because the loop is formed, the recording medium S is prevented from being pulled by both the transfer nip A and the registration roller pair 75 during the transfer of the toner image in the transfer nip A. Consequently, defective image formation due to the slippage of the toner image in the transfer nip A can be prevented.

After being conveyed at the conveying speed of the conveying belt 45, the recording medium S is conveyed to the secondary transfer nip (S109). The secondary transfer is performed such that the leading edge of the toner image coincides with the leading edge of the recording medium S in the transfer nip A (S110).

As described above, the toner image borne on the intermediate transfer belt 31 includes the margin on the side of the leading edge of the recording medium S to which the toner image is transferred. Therefore, by conveying the recording medium S such that the leading edge of the toner image and the leading edge of the recording medium S coincide when the toner image is transferred to the recording medium S in the transfer nip A, the toner image can be transferred to the proper position on the recording medium S.

After that, it is checked whether there are any subsequent sheets (S111). If YES, the driving of the registration roller pair 75 is stopped (S112), and the driving of the registration roller pair 75 is started again (S103). If NO in the step S111, the driving of the registration roller pair 75 is stopped (S113), and the processing is ended.

In this embodiment, the conveying speed of the registration roller pair 75 is slower than the conveying speed of the conveying belt 45 until the post-registration sensor SN detects the leading edge of the recording medium S. However, as long as a loop is prevented from being formed in the recording medium S between the conveying belt 45 and the registration roller pair 75 until the post-registration sensor SN detects the leading edge of the recording medium S, the conveying speed of the registration roller pair 75 does not necessarily have to be slower than the conveying speed of the conveying belt 45. For example, the conveying speed of the registration roller pair 75 may be equal to the conveying speed of the conveying belt 45 until the post-registration sensor SN detects the leading edge of the recording medium S. In the case where the conveying speed of the registration roller pair 75 is equal to the conveying speed of the conveying belt 45 until the post-registration sensor SN detects the leading edge of the recording medium S, the conveying speed of the registration roller pair 75 is reduced to less than the conveying speed of the conveying belt 45 after the detection of the leading edge of the recording medium S by the post-registration sensor SN and is then increased at the appropriate timing.

In the case where the conveying speed of the registration roller pair 75 is faster than the conveying speed of the conveying belt 45 until the post-registration sensor SN detects the leading edge of the recording medium S, a loop is formed in the recording medium S between the conveying belt 45 and the registration roller pair 75. For example, in the case where the recording medium S is conveyed at a speed faster than the process speed to a predetermined position between the registration roller pair 75 and the post-registration sensor SN, a loop may be formed in the recording medium S between the conveying belt 45 and the registration roller pair 75. However, if a loop is formed in the recording medium S when the leading edge is detected, the loop is flattened by attraction of the conveying belt 45 when the registration roller pair 75 is decelerated or stopped. As a result, by flattening the loop, the leading edge of the recording medium S is slightly displaced in the recording medium conveying direction. Therefore, the conveying speed of the registration roller pair 75 is desirably set equal to or less than the conveying speed of the conveying belt 45 until the post-registration sensor SN detects the leading edge of the recording medium S. However, as long as there is no loop in the recording medium S at the time of detection, the conveying speed of the registration roller pair 75 does not necessarily have to be equal to or less than the conveying speed of the conveying belt 45. That is to say, if the conveying speed of the registration roller pair 75 is faster than the conveying speed of the conveying belt 45 and a loop is formed in the recording medium S, the loop can be flattened by reducing the conveying speed of the registration roller pair 75 by the time the post-registration sensor SN detects the leading edge of the recording medium S.

In this embodiment, after the leading edge of the recording medium S is detected, the conveying speed of the registration roller pair 75 is changed at the appropriate timing to a conveying speed equal to or greater than the conveying speed of the conveying belt 45. However, after the leading edge of the recording medium S is detected, the registration roller pair 75 may be decelerated or stopped and then the conveying speed of the registration roller pair 75 may be changed at the appropriate timing to a conveying speed equal to or greater than the conveying speed of the conveying belt 45. The term "decelerating or stopping the registration roller pair 75" means reducing the conveying speed of the registration roller pair 75 to less than the conveying speed of the conveying belt 45.

In this embodiment, after the leading edge of the recording medium S is detected, the conveying speed of the registration roller pair 75 is changed at the appropriate timing to a conveying speed equal to or greater than the conveying speed of the conveying belt 45. However, after the leading edge of the recording medium S is detected, the registration roller pair 75 may be accelerated to a speed slower than the conveying speed of the conveying belt 45 and then the conveying speed of the registration roller pair 75 may be changed at the appropriate timing to a conveying speed equal to or greater than the conveying speed of the conveying belt 45. That is to say, the conveying speed of the registration roller pair 75 at the time before the post-registration sensor SN detects the leading edge of the recording medium S may be changed to a conveying speed slower than the conveying speed of the conveying belt 45 and slower than the conveying speed after the detection.

As described above, according to the present invention, the leading edge of the recording medium S attracted to the conveying belt 45 is detected, and the registration roller pair 75 is controlled such that the leading edge of the toner image and the leading edge of the recording medium S coincide. This can reduce displacement of the toner image transferred onto the recording medium S in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-224836 filed Sep. 29, 2009, which is hereby incorporated by reference herein in its entirety.

What is claimed is:

1. An image forming apparatus comprising:

a pre-transfer conveying portion that conveys a recording medium;

an image bearing member that moves while bearing a toner image;

a conveying belt that is pressed against the image bearing member, that has a conveying force smaller than the conveying force of the pre-transfer conveying portion, and that attracts the recording medium conveyed from the pre-transfer conveying portion to the outer surface and conveys the recording medium at the same speed as the image bearing member;

a transfer nip that conveys the recording medium while nipping the recording medium between the conveying belt and the image bearing member and thereby transfers the toner image borne by the image bearing member to the recording medium;

a recording medium detecting portion that is located on an upstream of the transfer nip in the recording medium conveying direction, that faces the conveying belt, and that detects a leading edge of the recording medium attracted to the conveying belt; and a control unit that controls the conveying speed at which the pre-transfer conveying portion conveys the recording medium, wherein the control unit is configured to control the conveying speed of the pre-transfer conveying portion so that the conveying speed of the pre-transfer conveying portion is slower than the conveying speed of the conveying belt at first when the pre-transfer conveying portion and the conveying belt conveys the recording medium while slipping on the conveying belt and so that a distance between a leading edge of the toner image on the image bearing member and the transfer nip is larger than a distance between the leading edge of the recording medium conveyed by the conveying belt and the transfer nip when the leading edge of the recording medium is detected by the recording medium detecting portion, and wherein, based on the detection of the leading edge of the recording medium attracted to the conveying belt by the recording medium detecting portion, the control unit calculates a timing to change the speed of the pre-transfer conveying portion such that a leading edge of the toner image on the image bearing member coincides with the leading edge of the recording medium to coincide at the transfer nip and at the timing changes the conveying speed of the pre-transfer conveying portion from the conveying speed slower than the conveying speed of the conveying belt to conveying speed equal to or faster than the conveying speed of the conveying belt while the recording medium is being attracted to the conveying belt.

2. The image forming apparatus according to claim 1, wherein if the conveying speed of the pre-transfer conveying portion is equal to the conveying speed of the conveying belt when the recording medium detecting portion detects the recording medium, based on the detection of the recording medium attracted to the conveying belt by the recording medium detecting portion, the control unit reduces the conveying speed of the pre-transfer conveying portion to a conveying speed slower than the conveying speed of the conveying belt and then changes the conveying speed of the pre-transfer conveying portion to a conveying speed equal to or faster than the conveying speed of the conveying belt so that the conveying belt conveys the recording medium while attracting the recording medium, and wherein, if the conveying speed of the pre-transfer conveying portion is slower than the conveying speed of the conveying belt when the recording medium detecting portion detects the recording medium, based on the detection of the recording medium attracted to the conveying belt by the recording medium detecting portion, the control unit changes the conveying speed of the pre-transfer conveying portion from a conveying speed the same as the conveying speed at the time when the recording medium detecting portion detects the recording medium to a conveying speed equal to or faster than the conveying speed of the conveying belt so that the conveying belt conveys the recording medium while attracting the recording medium.

3. The image forming apparatus according to claim 1, wherein, if the conveying speed of the pre-transfer conveying portion is equal to the conveying speed of the conveying belt when the recording medium detecting portion detects the recording medium, based on the detection of the recording medium attracted to the conveying belt by the recording medium detecting portion, the control unit reduces the conveying speed of the pre-transfer conveying portion to a conveying speed slower than the conveying speed of the conveying belt and then changes the conveying speed of the pre-transfer conveying portion to a conveying speed equal to or faster than the conveying speed of the conveying belt so that the conveying belt conveys the recording medium while attracting the recording medium, and wherein, if the conveying speed of the pre-transfer conveying portion is slower than the conveying speed of the conveying belt when the recording medium detecting portion detects the recording medium, based on the detection of the recording medium attracted to the conveying belt by the recording medium detecting portion, the control unit changes the conveying speed of the pre-transfer conveying portion to a conveying speed different from the conveying speed at the time when the recording medium detecting portion detects the recording medium and slower than the conveying speed of the conveying belt and then changes the conveying speed of the pre-transfer conveying portion to a conveying speed equal to or faster than the conveying speed of the conveying belt so that the conveying belt conveys the recording medium while attracting the recording medium.

4. The image forming apparatus according to claim 1, wherein, the timing calculated by the control unit is that a distance between the leading edge of the recording medium attracted to the conveying belt and the transfer nip becomes equal to a distance between a leading edge of the toner image on the image bearing member and the transfer nip, and the control unit changes, based on the timing, the conveying speed by the pre-transfer conveying portion from the conveying speed slower than the conveying speed of the conveying belt to the conveying speed equal to or faster than the conveying speed of the conveying belt.

5. A sheet conveying method used in an image forming apparatus comprising an image bearing member that moves while bearing a toner image; a conveying belt that is pressed against the image bearing member to form a transfer nip and that attracts a recording medium to the outer surface and conveys the recording medium at the same speed as the image bearing member; and a recording medium detecting portion, facing the conveying belt, that detects the recording medium attracted to the conveying belt, the method comprising:

conveying the recording medium by both a pre-transfer conveying portion and the conveying belt at the conveying speed that is slower than the conveying speed of the conveying belt while slipping the recording medium on the conveying belt;

conveying the recording medium so that a distance between a leading edge of the toner image on the image bearing member and the transfer nip is larger than a distance between the leading edge of the recording medium conveyed by the conveying belt while slipping on the conveying belt and the transfer nip when the leading edge of the recording medium is detected by the recording medium detecting portion;

detecting the leading edge of the recording medium attracted to the conveying belt with the recording medium detecting portion;

calculating, based on the detection of the leading edge of the recording medium attracted to the conveying belt in the detecting step, the timing to change the conveying speed of the leading edge of the recording medium attracted to the conveying belt from a conveying speed slower than the conveying speed of the conveying belt to a conveying speed the same as the conveying speed of the conveying belt such that the leading edge of the recording medium attracted to the conveying belt coincides with a leading edge of the toner image borne by the image bearing member at the transfer nip;

changing the conveying speed of the leading edge of the recording medium attracted to the conveying belt, at the timing calculated in the calculating step, from a conveying speed slower than the conveying speed of the conveying belt to the conveying speed of the conveying belt; and transferring the toner image on image bearing member to the recording medium attracted to the conveying belt at the transfer nip.

6. The sheet conveying method according to claim 5, wherein when the recording medium detecting portion detects the recording medium, the recording medium is caused to slip on the conveying belt.

7. The sheet conveying method according to claim 5, wherein, changing the conveying speed of the leading edge of the recording medium at the timing that a distance between the leading edge of the recording medium attracted to the conveying belt and the transfer nip becomes equal to a distance between a leading edge of the toner image on the image bearing member and the transfer nip.

* * * * *